US012692448B2

(12) United States Patent
Peterson et al.

(10) Patent No.: US 12,692,448 B2
(45) Date of Patent: Jul. 28, 2026

(54) HYDROTREATMENT OF PYROLYZED OIL DERIVED FROM PLASTIC WASTE STOCK

(71) Applicant: RES POLYFLOW LLC, San Francisco, CA (US)

(72) Inventors: Richard K. Peterson, Huntertown, IN (US); Mehmet A. Gencer, Brecksville, OH (US); Jay Schabel, Hiram, OH (US)

(73) Assignee: Brightmark Plastics Renewal Technologies LLC, San Francisco, CA (US)

( * ) Notice: Subject to any disclaimer, the term of this patent is extended or adjusted under 35 U.S.C. 154(b) by 254 days.

(21) Appl. No.: 18/421,225

(22) Filed: Jan. 24, 2024

(65) Prior Publication Data

US 2024/0263087 A1 Aug. 8, 2024

Related U.S. Application Data

(60) Provisional application No. 63/441,561, filed on Jan. 27, 2023.

(51) Int. Cl.
*C10G 65/02* (2006.01)

(52) U.S. Cl.
CPC ..... *C10G 65/02* (2013.01); *C10G 2300/1003* (2013.01); *C10G 2300/201* (2013.01)

(58) Field of Classification Search
CPC ..... C02F 2305/10; C07K 14/415; C10G 1/10; C10G 2300/1003; C10G 2300/201;
(Continued)

(56) References Cited

U.S. PATENT DOCUMENTS 4,380,510 A 4/1983 D'Aniello, Jr.
5,849,964 A 12/1998 Holighaus et al.
(Continued)

FOREIGN PATENT DOCUMENTS

CN 114437776 A 5/2022
EP 2847302 B1 8/2017
(Continued)

OTHER PUBLICATIONS

International Search Report and Written Opinion dated Jun. 14, 2024 for corresponding International Application PCT/US2024/012728.

(Continued)

*Primary Examiner* — Ellen M McAvoy
*Assistant Examiner* — Chantel Graham
(74) *Attorney, Agent, or Firm* — Hudak, Shunk & Farine Co. LPA

(57) ABSTRACT

Contaminants of one or more compounds comprising olefins, various metals, heteroatoms comprising nitrogen, oxygen, phosphorous, sulfur, and silicon, various halogens, salts, and particulates, are typically contained in oil derived from the pyrolyzation of plastic waste material. These contaminants are removed by a process wherein a first catalytic reactor hydrogenates, i.e. saturates, the one or more contaminants at relatively low temperatures. Various remaining contaminants are removed by a subsequent catalytic reactor, that generally has a higher hydrogenation temperature than the first reactor. The purified, recovered oil can be utilized for heating various, furnaces, reactors, boilers, stoves, and the like, or sold for use in various commercial oil products.

21 Claims, 3 Drawing Sheets

(58) Field of Classification Search
CPC ..... C10G 65/02; C12N 15/8287; C12N 15/8289; Y02W 10/37
See application file for complete search history.

(56) References Cited

U.S. PATENT DOCUMENTS

| | | | |
|---|---|---|---|
| 10,233,395 | B2 | 3/2019 | Ward et al. |
| 10,711,202 | B2 | 7/2020 | Schabel et al. |
| 11,118,114 | B2 | 9/2021 | Schabel et al. |
| 2019/0010405 | A1 | 1/2019 | Moore et al. |
| 2019/0256781 | A1 | 8/2019 | Baker |
| 2021/0130711 | A1 | 5/2021 | Sundararaman et al. |
| 2022/0235276 | A1 | 7/2022 | Paasikallio et al. |
| 2023/0029587 | A1 | 2/2023 | Weiss et al. |

FOREIGN PATENT DOCUMENTS

| | | | |
|---|---|---|---|
| EP | 3633013 | A1 | 4/2020 |
| EP | 4119636 | A1 | 1/2023 |
| WO | 2021165178 | A1 | 8/2021 |
| WO | 2021204817 | A1 | 10/2021 |
| WO | 2022144235 | A1 | 7/2022 |

OTHER PUBLICATIONS

Communication of Third Party Observation mailed Mar. 20, 2025 in corresponding International Application PCT/US2024/012728.

HYDROTREATMENT OF PYROLYZED OIL DERIVED FROM PLASTIC WASTE STOCK

FIELD OF THE INVENTION

Pyrolytic reactors can transform various plastic and hydrocarbonaceous waste feedstock and the like into oils and also various gases that when condensed are oils. Such oils are generally contaminated with various compounds such as olefins, metals, salts, various particulates, heteroatoms, and halogens that need to be removed before the oil can be utilized for conventional purposes. Accordingly, systems are provided for removing said contaminants.

BACKGROUND OF THE INVENTION

There are unique contaminants inherent in waste plastic derived oils that need to be addressed to make them usable as fuels or as feedstock such as for cracking reactors (steam, thermal, or catalytic). Compounds containing double bonds (olefins) are a problem as they can be unstable in storage or transport and can cause fouling of various items such as heat exchangers in a chemical plant or refinery. Additionally, metals such as Na, Ca, Ni, V, Fe, Cu, Zn, or K, as well as salts thereof, and heteroatoms (Si, P, O, N, S, in particular) reduce efficiency or cause fouling of refineries, chemical plants, or fuel utilization processes. Halogens such as chlorine, bromine, fluorine, etc., are a problem endemic to waste plastic. Most crude oil derived streams will have below 10 ppm chloride going into the crude column of the refinery or chemical plant. However, oil from waste plastic streams can have tens to thousands of ppm of chlorides. This causes corrosion issues. Many facilities overcome the above problems by blending the waste plastic derived oils with crude oil streams to render the amount of the contaminants negligible, or pay higher prices for carefully controlled feedstocks.

The above contaminants also cause problems with respect to traditional hydrotreating. For example, halogens, such as chlorides, cause corrosion and salt deposition/plugging when combined with ammonia in a hydrotreater. Due to the high concentration of halogens such as chlorides, and/or heteroatoms such as nitrogen, this deposition happens much earlier (at higher temperatures) in the present invention than is common in refineries, so a water wash is utilized early in the system to prevent deposition and under-deposit corrosion. The water wash should have low chloride concentration, and generally low total dissolved solids. Compounds such as double bonds contained in olefins, are endemic to cracked materials, such as plastic derived oil, are very reactive and can cause crosslinking or coking in catalysts, and if treated at high temperatures can lead to uncontrolled exotherms that cause acute catalyst damage or safety concerns. Furthermore, heteroatoms such as silicon if contained in the waste plastic stream can foul and or deactivate catalysts much earlier in the catalyst run time than expected at a conventional refinery. Heteroatoms also increase hydrogen demand and can cause fouling or deactivation of catalyst.

SUMMARY OF THE INVENTION

The present invention generally relates to a multiple reactor process, treatment, or system, whereby contaminants are retracted, removed, and otherwise rendered harmless in plastic waste derived oils. The term "reactor", when used herein, is to be understood as referencing a catalytic reactor, unless expressly defined otherwise. The purified oil is acceptable for feeding commercial or standard steam crackers or other monomer producing equipment. A plurality of hydrotreater-catalytic reactors (using hydrogen gas) are used that have solid walls, i.e. side, bottom, and top, to maintain hydrogen gas within the reactors. The multiple reactor system comprises a first reactor and one or more subsequent reactors. Desirably, at least two hydrotreater reactors are utilized, a low temperature reactor and a relatively higher temperature hydrotreater reactor. Olefins are treated at lower temperatures to reduce the risk of uncontrolled exotherms. The reactor also acts as a guard bed, soaking up metals and also heteroatoms, e.g. one or more of Si, N, P, O, or S, etc. The initial low temperature reactor can be duplexed to allow for quick, on stream bed changes if high amounts of contaminants deactivate the catalytic reactor early. A second or subsequent hydrotreater reactor operates at a higher temperature to remove the noted heteroatoms, and saturate some of the aromatics to remove color. The removal of these compounds is important in order to meet environmental, fuel or chemical feedstock specifications. The reactors also remove contaminants that often plug pipes and heat exchangers and/or cause corrosion. For example, salt plugs generally form at higher temperatures, near the reactor exit when treating plastic pyrolysis derived oils. The present invention solves this problem by locating a thermal sleeve 210 close to the exit of the second hydrotreater (catalytic reactor) such as shown in FIG. 2, so that salt plugs can be washed out. Another aspect of the present invention is that the water flow is also higher to achieve 20-25% liquid water retention after injection, even at higher temperatures. This is distinct from common practice in that the injection point is at a temperature a few hundred degrees above the water dew point, which requires much higher water flow rates than typical of a water wash step to achieve the liquid water requirements previously stated. Another aspect of the present invention is the injection of wash water into the system immediately after the second and or subsequent reactor.

A further aspect of the invention is incorporation of a high recycle flow of cooled, processed oil. This high recycle rate (about equal to the fresh feed rate) helps to reduce the temperature rise from hydrotreatment by diluting reactive material with inert material that helps absorb heat from the reaction. Additionally, the high recycle rate increases the velocity of flow through the tubes of the preheat exchangers. The increased velocity makes for more turbulent flow in the pipes, which reduces the likelihood of pipe fouling. Chemical additives may also be included with the feed stream to reduce deposition and other fouling in the preheat exchangers and piping. The invention also includes a high recycle rate of hydrogen, to remove halogens, to dilute contaminants in the vapor stream, and also to reduce salt deposition.

In one aspect, a method for removing contaminants from a pyrolyzed plastic feed stream containing various hydrocarbon oils and contaminants is disclosed comprising the steps of feeding a contaminated oil feed stream at a temperature of from about 200° F. (94° C.) to about 750° F. (399° C.) to a multiple reactor system comprising a first catalytic reactor and one or more subsequent reactors, said contaminants comprising one or more olefins; or one or more metal or organic metal compounds; or one or more salts; or one or more particulate-containing compounds; or one or more heteroatoms; or one or more halogens; or any combination thereof; hydrogen saturating said one or more organic metals, or said one or more olefin contaminants, or said one or more metal contaminants, or said one or more salts, or said one or more particulates, or said one or more heteroatoms contaminants, or said one or more halogen contaminants, or any combination thereof, in said first catalytic reactor, wherein the partial hydrogen pressure of said first reactor is from about 200 psig (1379 kPa) to about 2,000 psig (13790 kPa); independently, feeding additional hydrogen and said hydrogen treated oil to said one or more subsequent second reactors having a temperature higher than said first reactor at a partial hydrogen pressure of at least about 200 psig (1379 kPa) to about 2,000 psig (13790 kPa); and removing said one or more reacted olefin contaminants, or said one or more reacted metal contaminants, or said one or more reacted salts, or said one or more reacted particulates, or said one or more reacted heteroatom contaminants, or said one or more reacted halogen contaminants, or any combination thereof, from said multiple reactor system.

In a further aspect, an apparatus for removing contaminants contained in an oil derived from a pyrolyzed plastic material is disclosed comprising a first hydrotreater reactor capable of reacting hydrogen gas with said contaminated oil; at least one or more subsequent hydrotreater reactors, independently, capable of further reacting hydrogen gas with said oil contaminants; said contaminants comprising one or more olefins; or one or more metals, an organic metallic compound, a metallic salt, and/or a particulate of a metal elemental; or one or more heteroatoms; or one or more halogens; and at least one separator capable of removing said one or more reacted olefins, or said one or more reacted heteroatoms, or any combination thereof from said contaminated oil fluid.

In all aspects, the hydrocarbon fed to the hydrotreater is a full range hydrocarbon stream, containing compounds that boil from about 100° F. (38° C.) to around 1200° F. (648° C.). This is unique from typical hydrotreating operations that will separate different products by boiling point ranges before sending them to a hydrotreater. For example, a typical refinery will have at least naphtha, diesel, and gas oil range streams pulled separately from their crude distillation tower, that will then go to separate naphtha, diesel, and gas oil hydrotreaters. They are separated because hydrotreating is done for different results on each stream, and typically treating them together will diminish product properties. For example, hydrotreating gasoline range and diesel range hydrocarbons together can reduce octane number of the gasoline (undesirable) while raising cetane number (desirable) of the diesel. Treating the full range hydrocarbon stream at once in this invention reduces the capital requirements for hydrotreating, while allowing for adequate product qualities for respective end uses.

In a further embodiment, this full range hydrocarbon oil feed stream is washed with water prior to being fed into the first catalytic reactor or hydrotreater. This water wash step is able to remove some portion of undesirable materials or contaminants, such as phosphorus, silicon, and halides, by incorporating them into the water phase. This water phase then disengages from the hydrocarbon oil feed stream, taking the contaminants with it.

The water wash step can be done in many ways, including with a mixing tank, with a spray of water, or with a static mixer to contact the oil and water. The separation of the hydrocarbon and water-containing mixture can be done by gravity in an oil water separator or settling tank, or with a centrifuge or other centrifugal means, or using electricity to affect the separation as in a desalting operation known to those of ordinary skill in the art. It is beneficial to use a clean water stream, such as a reverse osmosis permeate stream, or a deionized water stream to maximize the removal of contaminants from the hydrocarbon oil into the water in the pre-washing step.

In one aspect, a method for removing contaminants from a pyrolyzed plastic feed stream containing various hydrocarbon oils and contaminants is disclosed, comprising the steps of:

feeding a full boiling point range, with boiling points ranging from about 100° F. (38° C.) to about 1200° F. (648° C.), of a contaminated oil feed stream at a temperature of from about 200° F. (93° C.) to about 750° F. (399° C.) to a first catalytic reactor of a multiple reactor system comprising the first catalytic reactor and one or more subsequent reactors including a second reactor, the contaminants comprising one or more olefins, or one or more metals, or one or more organic metal compounds; or one or more salts, or one or more particulate containing compounds, or one or more heteroatoms; or one or more halogens, or any combination thereof;

treating the oil feed stream with hydrogen to hydrogen saturate the contaminants in the first catalytic reactor thereby producing reacted contaminants, wherein the partial hydrogen pressure of the first reactor is from about 200 (1379 kPa) to about 2,000 psig (13790 kPa);

transferring the oil feed stream including the reacted contaminants to the second reactor;

feeding additional hydrogen to the second reactor which has a temperature higher than the first reactor and a partial hydrogen pressure of at least about 200 psig (1379 kPa) to about 2,000 psig (13790 kPa); and removing the reacted contaminants comprising the one or more reacted olefins, or the one or more reacted metals, or the one or more reacted salts, or the one or more reacted particulate containing compounds, or the one or more reacted heteroatoms, or the one or more reacted halogens, or any combination thereof, from the multiple reactor system.

In a further aspect, the method includes the step of injecting wash water into the contaminated oil feed stream after the second reactor.

In an additional aspect, the method further includes the step of recycling a quantity of the hydrogen treated oil feed stream from a separator, located downstream from one of the subsequent reactors, back into the first reactor.

In an additional aspect the one or more olefins comprise an olefin having a total of from 2 to about 40 carbon atoms; wherein the one or more of metals comprise an elemental metal; wherein the particulate containing compounds comprises sodium, calcium, nickel, vanadium, iron, copper, zinc, or potassium, or any combination thereof; wherein the one or more heteroatoms comprise nitrogen, silicon, phosphorous, sulfur, or oxygen, or any combination thereof; and wherein the one or more halogens comprise chlorine, bromine, or fluorine, or any combination thereof.

In a still further aspect, the method includes reacting a majority of said olefins in the first or the one or more subsequent reactors, wherein the oil temperature of the oil feed stream fed to the first reactor is from about 225° F. (107° C.) to about 600° F. (316° C.), wherein the partial hydrogen pressure thereof is from about 600 psig (4137 kPa) to about 1,600 psig (11032 kPa), and independently, reacting unreacted olefins with hydrogen gas in the second or the one or more subsequent reactors, and converting the olefins to an alkane, wherein a temperature of the oil feed stream fed to the one or more subsequent reactors, independently, is from about 550° F. (288° C.) to about 900° F. (482° C.) and wherein the partial pressure in the one or more subsequent reactors, independently, is from about 400 psig (2758 kPa) to about 1,600 psig (11031 kPa).

In a further aspect, the oil temperature of the oil feed stream fed to the first reactor is from about 250° F. (121° C.) to about 500° F. (260° C.) and the partial hydrogen pressure thereof is from about 600 psig (4137 kPa) to about 1,600 psig (11032 kPa), and wherein the oil temperature of the oil feed stream fed to the one or more subsequent reactors, independently, is from about 650° F. (343° C.) to about 750° F.). (399° ° C., wherein the partial hydrogen pressure thereof is from about 600 psig (4137 kPa) to about 1,600 psig (11032 kPa), and optionally recycling the hydrogen and optionally recycling the oil.

In another aspect, the method includes the step of tracking of an amount of nitrogen and halides being fed to the front reactor to ensure that there is enough nitrogen to neutralize the halides in the feed stream.

In a further aspect, the method includes the step of water washing the contaminated oil feed stream, then separating the water before feeding the contaminated oil feed stream to the first reactor, in order to remove some contaminants.

In another aspect, the separator is a high pressure separator having a pressure of at least 400 psig (2758 kPa); and further including a second separator that is a low pressure separator capable of having a pressure of about 100 psig (690 kPa) or less; wherein the high pressure separator is capable of separating unreacted hydrogen, water, the hydrogen treated oil, and reacted heteroatom contaminants.

In still another aspect, the oil temperature of the oil feed stream fed to the first reactor temperature in the first reactor is from about 250° F. (121° C.) to about 500° F. (260° C.), and wherein the oil temperature of the oil feed stream fed to the one or more subsequent reactors, independently, is from about 650° F. (343° C.) to about 750° F. (399° C.).

In another aspect, the method includes a water feed line, wherein the water feed line is connected to a pipeline connected to an outlet of the second reactor adjacent to the outlet, and further including the step of introducing water into the pipeline from the water feed line.

In still a further aspect, the method further includes the step of performing a cracking reaction with a catalyst present in one or more of the first catalytic reactor and the one or more subsequent reactors which utilizes the one or more halogen contaminants in the reaction.

In another aspect, one or more of the first reactor and the one or more subsequent reactors, independently, contain one or more of perforated trays and perforated tubes.

In another aspect, an apparatus for removing contaminants contained in a contaminated oil feed stream derived from a pyrolyzed plastic material is disclosed, comprising:

- a first hydrotreater reactor capable of reacting hydrogen gas with a component of the contaminated oil feed stream;
- at least one or more subsequent hydrotreater reactors located downstream from the first hydrotreater reactor in a process flow line and, independently, capable of further reacting additional hydrogen gas with a component of the contaminated oil feed stream;
- wherein the contaminants comprise one or more olefins, or one or more metals, or one or more organic metal compounds, or one or more salts, or one or more particulate containing compounds, or one or more heteroatoms, or one or more halogens, or any combination thereof; and
- at least one separator operatively connected downstream from a last of the one or more subsequent hydrotreater reactors, the at least one separator capable of separating one or more reacted olefins, or one or more reacted heteroatoms, or any combination thereof from the contaminated oil feed stream.

In a further aspect, the apparatus includes at least one heater that heats the contaminated oil feed stream before it is admitted to the first reactor; further including at least one or more subsequent heaters that heat the contaminated oil feed stream egressing from the first reactor to a temperature of about 550° F. (288° C.) to about 900° F. (282° C.) prior to being fed to at least one of the at least one subsequent hydrotreater reactors, and further including at least one water wash pipeline that is connected to a pipeline connected to an outlet of the at least one subsequent reactor which is capable of introducing water into the pipeline from the water wash pipeline.

In still another aspect, the apparatus further includes at least two separators, with the first separator being a high pressure separator having a pressure of at least 400 psig (2758 kPa) and a second separator that is a low pressure separator having a pressure of about 100 psig (690 kPa) and/or wherein the low pressure separator is capable of separating gas from the hydrotreated oil received from the high pressure separator which is located upstream from the low pressure separator.

In a further aspect, the apparatus further includes a recycle line extending from the at least one separator to the first reactor, whereby a portion of the hydrotreated oil from the separator is recyclable to the first reactor.

In still a further aspect, the apparatus includes a water washing station located upstream from the first hydrotreater reactor which is capable of washing the contaminated oil feed stream in order to remove some contaminants prior to the contaminated oil feed stream being transferred to the first hydrotreater reactor.

In a still further aspect, the apparatus includes a catalyst in one or more of the first hydrotreater reactor and the at least one or more subsequent hydrotreater reactors which can utilize the one or more halogens in a cracking reaction.

In a further aspect, one or more of the first catalytic reactor and the one or more subsequent reactors, independently, contain one or more of perforated trays and perforated tubes.

For clarity and the avoidance of doubt, it is to be understood that all aspects disclosed herein are optionally able to be combined. It should also be clear that different claims can likewise also be combined with one another according to the present invention.

BRIEF DESCRIPTION OF THE DRAWINGS

The foregoing and other features of the present invention will become apparent to those skilled in the art to which the present disclosure relates upon reading the following description with reference to the accompanying drawings, in which:

FIG. 2 is a detailed schematic flow diagram of a preferred embodiment of the present invention showing a first reactor and a subsequent second reactor, various connecting pipes, a water wash system that is utilized to abate or eliminate salt plugs, heat exchangers, as well as an oil recovery system, and the like.

DETAILED DESCRIPTION OF THE INVENTION

Pyrolytic reactors that treat and/or react plastic waste materials such as polyethylene, polypropylene, polyesters, polystyrene, and the like, generally produce oils, as well as gases that upon condensation generally form additional oils. Such oils can be generated in a manner as set forth in U.S. Pat. Nos. 10,711,202 and 11,118,114 that are owned by RES Polyflow LLC of San Francisco, CA, both of which are fully incorporated by reference with regard to all aspects thereof. The boiling point of the composite (contaminated) oil of the present invention is large, that is from about 100° F. (38° C.) to about 1,200° F. (649° C.). These oils, that are often contaminated with olefins, metals, heteroatoms, and halogens, are fed via a pipeline or feed stream to a plurality of catalytic converters that treat the oil and remove the various contaminants therefrom. A preferred type of a catalytic converter reactor is a hydrotreater-catalytic reactor that contains hydrogen gas that treats, reacts, saturates, or removes, or any combination thereof, the contaminants so that the remaining hydrocarbon oil is suitable for commercial uses known to the literature and to the art.

The hydrotreater system of the present invention generally comprises multiple catalytic reactors such as two or more reactors that remove various contaminants therefrom. By the term "contaminants", it is meant compounds that are not environmentally friendly, or can cause fouling, blockage, corrosion, or damage to various refinery, chemical plants, and other types of facilities. Examples include, but are not limited to various olefins, various metals or metal containing compounds, various salts, various heteroatom compounds, various particulate-containing compounds, and one or more halogens.

Figure 1:
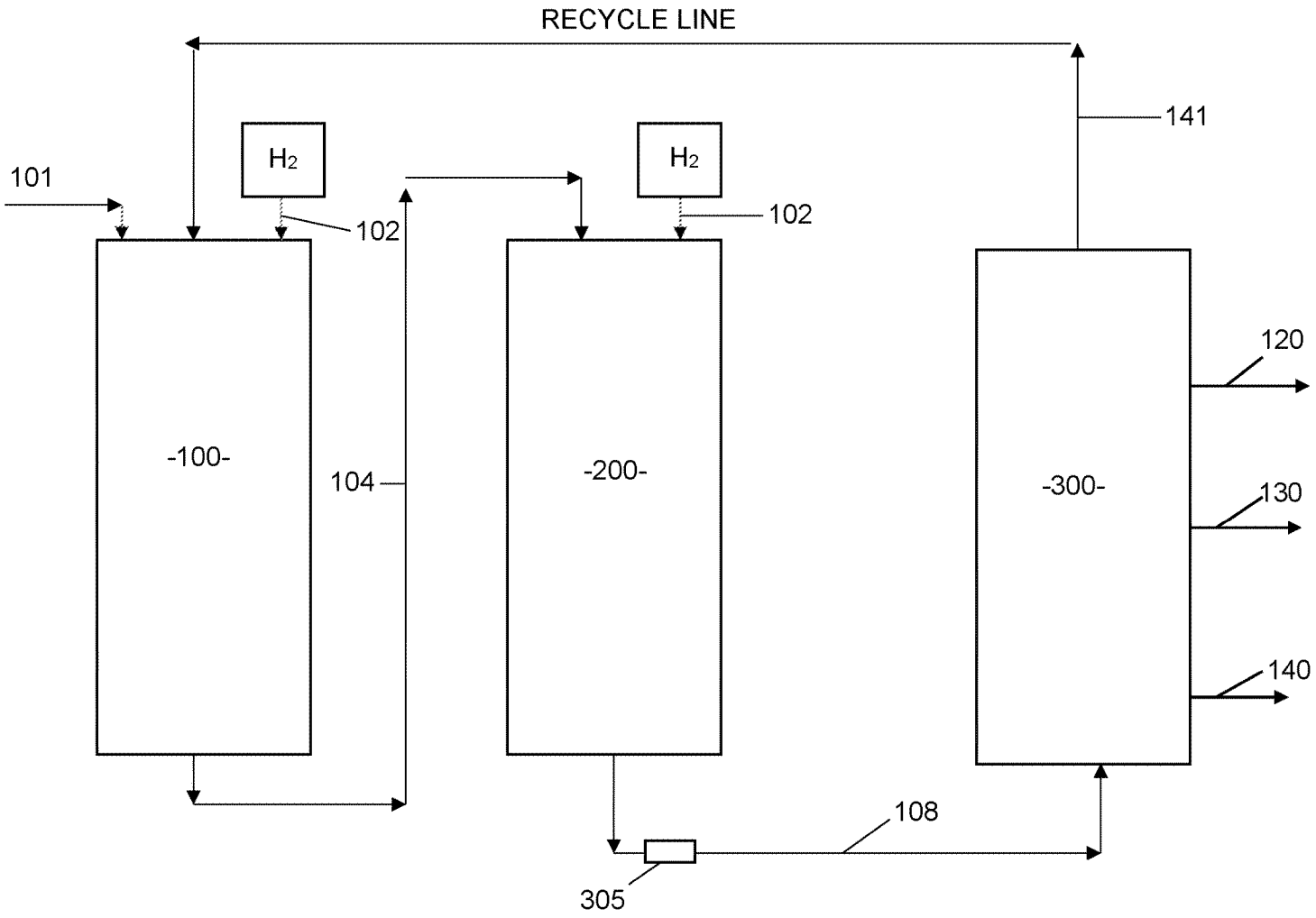
FIG. 1 is a generic flow diagram of the present invention.

FIG. 1 sets forth a general, broad schematic flow diagram of the hydrotreatment system of the present invention that feed and treat the pyrolyzed oil that contains undesirable contaminants therein found in a plastic waste derived oil. In other words, it is a general indication of some of the key items or structures that are necessary to form a workable embodiment of the present invention.

The hydrotreater-catalytic process of the present invention has advantageously been found to require at least two separate reactors, preferably utilized in sequence or tandem. Naturally, the physical requirements of the reactor materials are that they are resistant to high temperatures, resistant to attack by hydrogen as well as oxidation and also chloride stress corrosion cracking, and thus are desirably made of stainless steel, chrome containing steels, molybdenum containing steels, high carbon steels, nickel alloys, and the like. The internals of the reactors may also contain perforated trays and or perforated tubes or pipes that would allow for mixing of various catalyst types when it is appropriate, along with simplified servicing of the catalyst beds and improved contact and distribution of liquid and gases with the catalyst material. The perforated tubes, pipes, and or trays will enable each reactor to have either single or multiple functionalities to improve the efficiency in removal or contamination of contaminants while minimizing or eliminating catalyst fouling. The perforated tubes, pipes, and or trays can also allow better temperature management in the reactor, particularly relating to exotherms from different types of catalysts.

Figure 2:
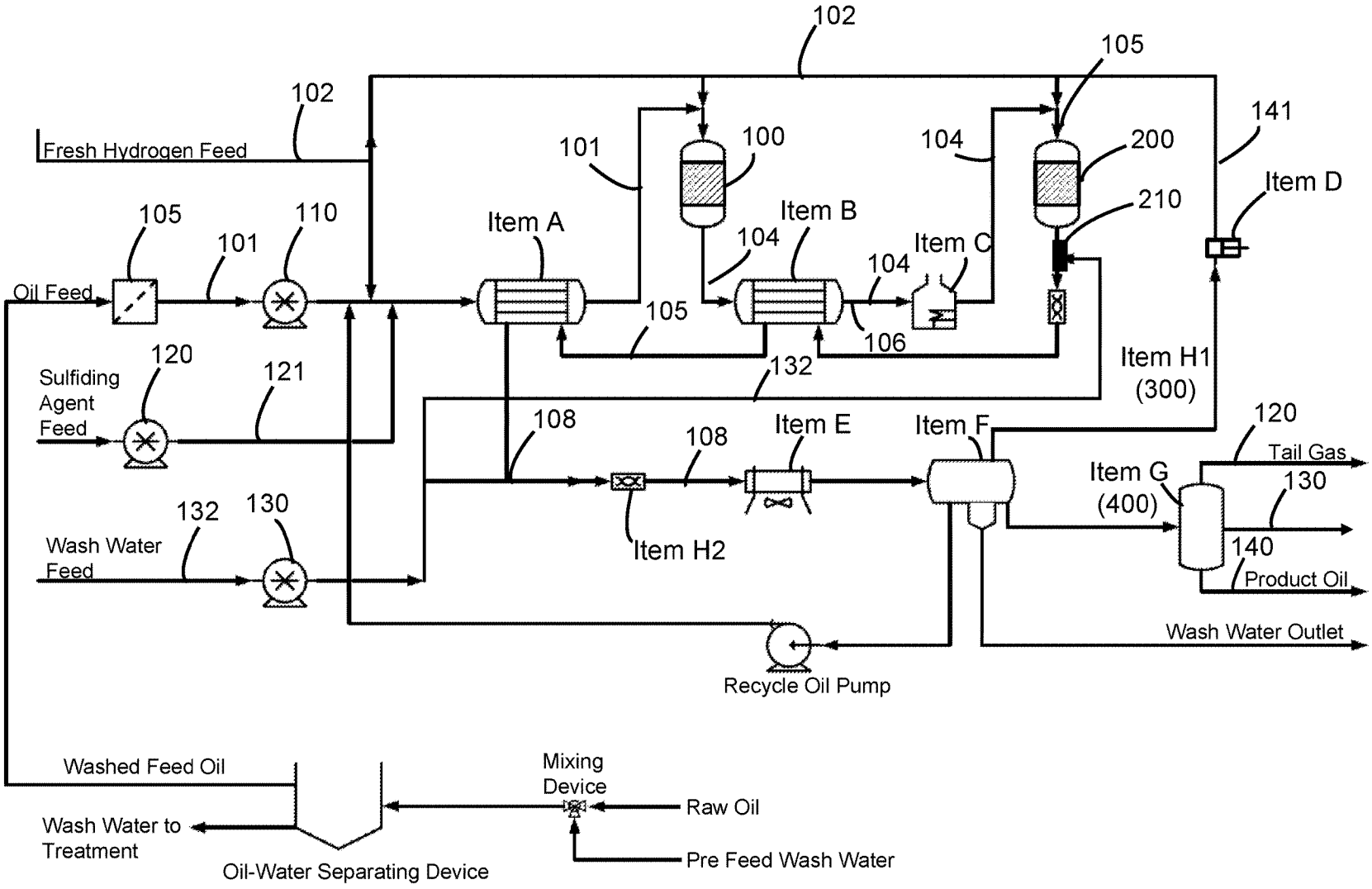

As shown in FIG. 1, hydrogen supply lines 102, respectively, feed hydrogen to hydrotreater-catalytic reactors 100 and 200 that contain various types of catalysts therein. These supply lines are preferably located early in the preheating train so that flow through the heat exchangers is a two-phase flow, i.e. liquid phase and vapor phase, that increases turbulence in the exchangers and reduces fouling therein. The purity of the hydrogen fed to hydrotreaters-catalytic reactors 100 or 200 is desirably at least 90%, and preferably at least about 95% or greater by volume. The partial pressure of the hydrogen gas is generally important and it has been found that high partial pressures (higher than necessarily needed for heteroatom removal, generally above about 600 psig (4137 kPa) typically resulted in reduced salt formation that can plug up hydrotreated oil transfer line 104 from initial hydrotreater 100 to the second hydrotreating-catalytic reactor 200, and also discharge pipeline 108 that feeds the hydrotreated oil to water wash injection point 305, that for maximum efficiency is located in close proximity to reactor 200 and can also include a static mixer, such as shown in FIG. 2. Typically, the various initial or first reactors and pipelines are pressurized to obtain a partial hydrogen pressure of about 200 psig (1379 kPa) to about 2,000 psig (13790 kPa), desirably from about 400 psig (2758 kPa) to about 1,600 psig (11032 kPa), with partial pressures of from about 1,200 psig (8274 kPa) to about 1,500 psig (10342 kPa) being preferred.

Another important aspect of the plurality of the hydrotreater-catalytic reactors such as initial reactor 100 is that the inlet temperature of contaminated oil contained in pipeline 101 is not high, and generally is from about 200° F. (94° C.) to about 750° F. (399° C.), desirably from about 225° F. (107° C.) to about 600° F. (316° C.), with a preferred inlet temperature being from about 250° F. (121° C.) to about 500° F. (260° C.). Higher temperatures have been found to cause the various pipelines 104 and 108 to become clogged, blocked, or have build-up therein of various blocking compounds such as salt, coking material, and the like. Furthermore, higher temperatures can cause damage to the catalyst inside reactor 100, or even potentially damage the vessel or reactor 100. The temperatures in the hydrotreater catalytic reactor 100, independently, are generally similar or the same as pipeline temperature 101 at the entrance to the reactor, but increase through the reactor due to reactions that occur therein.

The partially hydrogen reacted contaminant oil from reactor 100 is subsequently heated and fed into reactor 200 which can be a second or one or more subsequent reactors that further hydrotreat or react with the remaining generally unreacted contaminant containing oil portions. The oil inlet temperature with regard to the second or one or more subsequent reactors such as reactor 200 or in oil inlet pipeline 104, independently, is generally from about 550° F. (288° C.) to about 900° F. (482° C.), desirably from about 600° F. (316° C.) to about 800° F. (427° C.), and preferably from about 650° F. (343° C.) to about 750° F. (399° C.). This temperature increase is generally obtained using a charge heater not shown in FIG. 1, but is "Item C" in FIG. 2, which can be a combustion heater or electric heater. It is noted that such temperature ranges can vary depending upon the type of contaminants being treated in the plastic waste derived oil. As noted above, the reactor temperatures in the second catalytic reactor 200, independently, are desirably higher than that of the first catalytic reactor 100 and generally is the same or similar as the temperatures of inlet pipeline 104 near or at the entrance of reactor 200. The hydrogen partial pressure of the second or any subsequent reactor, e.g. reactor 200, or pipeline 104, independently, is generally from about 200 to about 2000 psig (13790 kPa), desirably from about 400 psig (2758 kPa) to about 1600 psig (11032 kPa), and preferably from about 800 to about 1400 psig (9653 kPa).

Reactor recovery system 300 shown generally in FIG. 1 can generally utilize any type of separator such as high-pressure separators, low pressure separators, or different types of distillation towers, or any combination of the above, for example see high pressure separator, Item F and low pressure separator Item G (400) in FIG. 2.

With respect to the various olefins found in the contaminated oils derived from the pyrolization of waste plastic, they usually contain one and often poly, i.e. two or more double bonds. The poly unsaturated bonds are generally a problem with regard to the use of the derived oils from a plastic feedstock since double bonds are very reactive. In storage and transport they can polymerize or react with air to darken, thicken, and create sludge. In processing, they can react to form films that foul heat exchangers, or polymerize in catalytic reactors causing fouling and coking of catalysts. Such olefins are generally treated by utilizing compounds that react with the double bonds (especially hydrogen) and generally convert the same to produce straight, branched, or ring style alkane type compounds that can be readily later separated out via fractionation, or other methods such as crystallization, solvent extraction, and the like. Examples of common olefins generally found in the contaminated oil include alpha olefins, having from about 2 to about 40 carbon atoms, such as 1-octene and the like. Diolefins, of course, contain two double bonds in the molecule. Olefins tend to form from thermal cracking of longer hydrocarbons and make an alkane or alkene at the point of scission in the molecule. If the alkene molecule cracks again, then there is a probability of one of the resulting molecules gaining another double bond and become a diolefin. The utilization of such olefins is carried out by the catalytic reactor containing hydrogen gas at the above-noted pressure. Generally, in the first hydrotreater-catalytic reactor 100, olefins or a majority thereof, (at least about 75%), and sometimes all of the polyolefins are saturated, that is hydrogen is added to the double bonds to convert them to alkanes. Polyolefins and monoolefins that are remaining after the first reactor are generally saturated in the second reactor 200 to alkanes.

Examples of typical hydrotreatment reactions include the following:

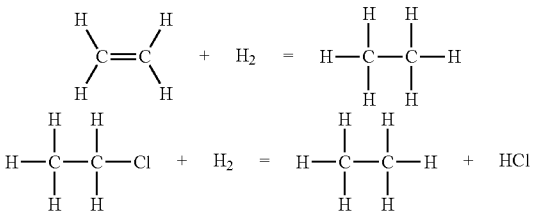

Another class of compounds that are desirably removed from the contaminated oil are various metals such as iron, copper, nickel, zinc, sodium, calcium, potassium, vanadium, and the like, or metal containing compounds thereof. These metals may be present as an elemental metal, an organometallic compound, a salt, and/or a metal containing particulate, or any combination thereof. The high surface activity of hydrotreating catalysts tend to sorb the various metallic species, where they can become chemically bonded to the support or active metal sites of the catalyst. If the metals are present as particulates, the particulates can be filtered out by the catalyst bed. However, they may adversely block the surface of the catalyst particles. This may lead to bridging of catalyst particles, poisoning of the catalyst, and lower catalyst activity, any of which may be reversible or irreversible. Also, lower reaction conversion through the reactor, or high pressure drops through the reactor, often result in requiring changing of the catalyst.

Accordingly, such metal compounds are generally removed by reaction in reactors 100 and 200, at the above noted temperatures and hydrogen pressures, by the use of catalysts such as various sulfided nickel-molybdenum catalysts, or sulfided cobalt-molybdenum catalysts, or any combination thereof. Also, catalysts residing on or located on bed grading materials such as extruded pellets or complex geometries of silica, alumina, carbon, aluminosilicates, metal oxides, or any combination thereof, that may be functionalized can be utilized to sorb the metal contaminants. The bed grading material generally tolerates solids loading while minimizing pressure drops. The catalysts are generally supported on a base of framework such as alumina (for example silica-alumina), and the like. These catalysts, bed grading material, and the like are well known to the art and literature, as for example set forth in KOKAYEFF, et al., Hydrotreating in Petroleum Processing, Handbook of Petroleum Processing, 2014, Springer Intl Publishing, hereby fully incorporated by reference. Removal of a majority of desirably about at least 60%, desirably at least about 90%, and preferably at least about 99% of the noted metals generally takes place in the first reactor 100.

It is also part of this invention that some of these undesirable contaminants can be removed by a water wash prior to hydrotreating. This water wash step is able to remove some portion of undesirable materials, such as phosphorus, silicon, and halides, by incorporating them into the water phase. This water phase then disengages from the hydrocarbon stream, taking the contaminants with it. The water wash step can be done in many ways, including with a mixing tank, with a spray of water, or with a static mixer to contact the oil and water. The separation of the hydrocarbon and water can be done by gravity in an oil water separator or settling tank, or with a centrifuge or other centrifugal means, or using electricity to effect the separation as in a standard desalting operation. This operation is shown in FIG. 2. It is beneficial to use a clean water stream, such as a reverse osmosis permeate stream, or a deionized water stream to maximize the removal of contaminants from the hydrocarbon into the water. This water wash step can reduce the amount of heteroatoms that need to be treated in the hydrotreater, but does not pre-empt the need to hydrotreat the oil to more fully remove contaminants.

The present invention is also very effective with regard to reacting hydrogen or the catalysts or the bed grading material with various heteroatoms so that later, the same can be removed in the gas phase or as salt in the water wash. Examples of such heteroatoms include silicon, nitrogen, phosphorous, oxygen, and sulfur, or any combination thereof.

Silicon is generally removed by reacting with the catalysts or the catalyst support, i.e. the catalyst-containing bed grading material in the first hydrotreatment reactor. If allowed in finished products, it will tend to foul catalysts and heat exchange surfaces by deposition.

Nitrogen is a contaminant that is often found in oils from the pyrolization of plastic waste. Nitrogen is harmful since it generally can lead to coking or fouling in utilization processes, and if combusted will increase NOx formation. As nitrogen is removed from the oil (generally in the second reactor) by the reaction thereof with hydrogen, it will form ammonia, which is also in the vapor phase. The ammonia and acids will combine in an acid-base reaction—which is beneficial because it neutralizes the acid, but it can also lead to salt formation (ammonium chloride/bromide/etc.). These salts will plug pipes, leading to high pressure drops, and if they are cold enough, can pull water from the vapor stream, hydrolyze, and form hydrochloric (or hydrobromic, hydrofluoric, etc.) acid under the salt deposit that causes severe corrosion. Therefore, enough water is injected to ensure that all of the salts are washed out, and no wet salt deposits are left behind to cause corrosion. It is also beneficial to track the amount of nitrogen in feed stream 101 to be sure it is in excess to neutralize the halides that are present. This can be done roughly by tracking the pH of the wash water stream (it should be neutral to slightly basic from the ammonia).

Phosphorous is generally removed by sorption and/or reaction with the catalytic bed material.

Oxygen can lead to corrosion of downstream utilization processes, and also can increase fouling or coking of the same processes. It is removed by reaction with hydrogen over the catalyst to form $H_2O$.

Sulfur is removed by reaction with hydrogen over the catalyst to form $H_2S$.

Various halogens such as chlorine, bromine, fluorine, and iodine can be treated as follows. Halogens in both the first and second hydrotreater reactors are converted by the hydrogen, and also the above-noted catalysts, hereby fully incorporated by reference, to their respective acids (hydrochloric, hydrobromic, or hydrofluoric, etc.), which tend to stay in the vapor phase. Some of the halogens will form salts with compounds in the oil stream. Subsequently they are sent to reactor recovery system 300. The separator can be a high-pressure separator, or a coalescer, or the like, such as Item F in FIG. 2 wherein the wash water with the halogen salt contaminated compounds is removed from oil feed stream 101 and 108. Separation of the halogen salts, of course occurs by phase separation from the oil feed stream. Reaction temperatures of the various halogen compounds are as noted above with respect to the first reactor, and also to a subsequent or second reactor. It is important to treat chlorides since they are often produced in amounts in excess of 100 parts per million of the oil and are very corrosive and thus can damage devices, machines, and other items in which the recovered oil is utilized. Still further, in an important aspect of the present invention, one or more catalysts present use the halides present in the feed stream to cause cracking reactions, thereby leading to fewer heavy, paraffin hydrocarbons, i.e. waxes, thereby reducing the amount of wax present in the oil.

A preferred embodiment for the hydrotreatment of pyrolyzed oil derived from plastic waste stock is set forth in FIG. 2. The oil inlet temperature from pipeline 101 or that entering first reactor 100, is the same as set forth hereinabove with respect to FIG. 1 and fully incorporated by reference. With respect to the second or subsequent hydrotreater-catalytic reactor 200, the oil inlet temperature is also the same as set forth hereinabove with respect to FIG. 1 and is also fully incorporated by reference. Also incorporated by reference are the partial hydrogen pressures of hydrogen feed stream in pipeline 101 and in reactor 100, as well as the partial hydrogen pressures entering the second or any subsequent hydrotreater-catalytic reactor 200, and the temperatures thereof, and the like. As shown in FIG. 2, the contaminated oil feed that is obtained from the pyrolytic reaction of various types of plastic in a manner such as, for example, set forth in U.S. Pat. No. 10,711,202 or 11,118,114, is initially subjected to feed filter 105 to at least partially remove the above-noted one or more olefins, or the one or more metals, or the one or more heteroatoms, as well as the one or more halogens, or one or more salts, or one or more particulates, or any combination thereof. Subsequently, oil charging pump 110 feeds the contaminated oil stream in pipeline 101 to Item A that is a heat exchanger to heat the oil to a desired temperature, for example from about 200° F. (93° C.) to about 750° F.). (399° ° C., and then to the first reactor 100. The heat supplied by heat exchanger Item A can be obtained in any conventional manner such as by using a combustible gas, a fuel gas such as kerosene, or fuel oil, or by exchange with a hotter process stream, and the like.

As shown in FIG. 2, heated contaminated oil feed in pipeline 101 is mixed with a hydrogen gas or feed stream 102 before it enters first reactor 100 that contains various catalysts therein as noted hereinabove such as a nickel molybdenum catalysts, or the like, and can be located in any conventional support such as various bed grading materials, extruded pellets, various geometric forms of silica, on aluminum, carbonate, alumina silicates, metal oxides, or any combination thereof. It is possible to mix two types of catalyst in layers to achieve removal of different contaminants, and even to create an exotherm or heat between catalyst layers in a single vessel such that all of the contaminants can be removed in a single reactor. However, this is generally more difficult to control than separating the reaction into two separate reactors. The contact of the contaminated oil with the catalyst generally reacts with most or a majority of the polyolefins existing within the contaminated oil feed stream being converted to various analogous monoolefins in said first reactor 100. Similarly, the various catalysts react with a majority of any metals within contaminated oil stream and are removed in said first reactor. Reactor 100 is also capable of removing some of the above-noted one or more different types of heteroatoms, as well as react with one or more halogens to produce, independently, hydrochloric acid, hydrobromic acid, hydrofluoric acid, or hydroiodic, and the like. The treated oil feed stream from reactor 100 is then fed via pipeline 104 to Item B that can be a heat exchanger similar to Item A that also recovers heat from the oil stream exiting from the outlet of reactor 100. The heated oil from heat exchanger Item B can be recycled to heat exchanger Item A via pipeline 105, or fed to Item C that is a charge heater to heat the contaminated oil stream to a desired temperature as noted hereinabove that is then fed to reactor 200. As with reactor 100, the treated oil stream is mixed with additional hydrogen gas from feed stream 102 desirably just before it is admitted to said reactor 200 wherein any further contaminants are reacted in the presence of various catalysts to further purify the contaminated oil stream. Thus, further purification of the contaminated oil is carried out by second reactor 200 and any other subsequent reactor utilized. The treated contaminated oil stream that is egressed from second reactor 200 is fed to static mixer Item H1 that mixes wash water from pipeline 132. Such mixers are known to the art and to the literature and can simply be vanes located inside a pipe to force the fluid to turn and mix with the injected water.

As shown in FIG. 2, wash water in pipeline 132 is fed via pump 130, to mix with contaminated oil that exits the second reactor 200 before it is added to static mixer Item H1. This mixed oil can then be recycled to heat exchanger Item B that in turn can either feed the treated oil to charge heater Item C via pipeline 106, or to heat exchanger Item A whereupon it can subsequently be recycled to first reactor 100 via pipeline 101, or to a second static mixer Item H2 via pipeline 108. The washed treated oil can be separated as discussed below and discharged from the hydrotreatment system.

A sulfiding agent can be added to oil stream pipeline 101 via pump 120 and pipeline 121.

An alternative route with respect to wash water feed 132 is that generally in addition to being fed to the treated oil egressing stream from reactor 200, it can also be fed directly to pipeline 108 egressing from heat exchanger Item A leading to static mixer Item H2 before it is then fed to Item E that is an air cooler and subsequently to separators, namely Items F and G. The purpose of air cooler Item E is of course to cool the treated oil before it is fed to Item F, a high-pressure separator that separates various components of the purification reactor system, i.e. water, oil, and various vapors. Examples of suitable separators include pressure separators, coalescers, one or more similar or different fractionating towers, and the like, as well as high pressure separator Item F as set forth in FIG. 2. Item F preferably is a three-phase high-pressure separator that separates water, oil, and vapors from each other with the vapor being mostly hydrogen that, subsequently, is usually fed to Item D, a recycle hydrogen compressor, whereby the unreacted hydrogen of the multiple reaction purification system is recycled via pipeline 141 to the second or any subsequent reactor, e.g. 200. The remaining components of the purified oil stream are generally a purified product oil or a tail gas that is separated by Item G, i.e. a low pressure separator. This separator separates the purified product oil via pressure, to tail gas via pipeline 120, or to pipeline 130 that includes a middle cut, or to a heavy cut in pipeline 140. The purified oil from pipeline 140 can be utilized with regard to various commercial applications such as fuel for furnaces, boilers, stoves, or oil that can be utilized in various commercial oil products. The pressure in high pressure separator Item F is from about 200 psig (1379 kPa) to about 2000 psig (13790 kPa), desirably from about 400 psig (2758 kPa) to about 1,600 psig (11032 kPa), and preferably from about 800 psig (2758 kPa) to about 1,400 psig (9652 kPa). The pressure in low pressure separator Item G is from about 0 to about 100 psig (690 kPa), and desirably from above 0 to about 10 psig (60 kPa).

A summary of various procedures, compounds, and the like that help remove the contaminants is as follows. Generally, low temperatures are utilized in the first reactor with slightly higher temperatures being utilized to the second or any subsequent reactor. Low temperatures have been found to reduce the amounts of olefins formed as well as to generally lower the formation of exotherm reactions. Such lower temperatures also have been found to improve the absorption of various metals as well as the improved removal of halogens. With respect to olefins, they generally are reacted with the hydrogen so they form saturated compounds which are less likely to cause fouling problems. Moreover, hydrogen will react with the double bonds of various diolefins and form alkanes that are removed with at the low-pressure separator. Metals including organic metallic compounds, metal salts, or particulate compounds containing a metal therein are generally absorbed by the various catalysts that are contained in the first reactor as well as the second or any subsequent reactor. As noted above, such catalysts contain silica, alumina, carbon, aluminosilicates, metal oxides, and the like. Generally, a high amount such as about 60%+ or 80%+ of such metal compounds are removed in the first reactor. Heteroatoms are generally removed in the second or any subsequent reactor as by reaction with hydrogen. Silicon can be reacted with various catalysts contained in the reactors and can be removed by adsorption. Nitrogen will react with hydrogen and form ammonia which can be removed as noted above. Oxygen, of course, when reacted with hydrogen will form water which is removed by the water wash outlet from the high-pressure separator. Sulphur is removed by generally reacting with hydrogen over a catalyst to form $H_2S$ which is generally in the form of a gas. The various halogens react with hydrogen and readily form the corresponding strong acid and tend to stay in the vapor phase and thus can be removed in the low-pressure separator.

An important aspect of the invention is that high recycle rates or amounts of the generally purified oil, as well as the unreacted hydrogen can be utilized to achieve higher amounts of the oil and/or removal of undesired contaminants from a contaminated oil. That is, with respect to the treated oil, the same can be recycled from Item F (a high-pressure separator) to oil feed pipeline 101 wherein it is fed via heat exchanger Item A to initial first reactor 100. The recycling of the purified oil helps control exotherms, for example high temperature of the recycled oil as well as incoming contained oil feed via pipeline 101. Similarly, recycling of the hydrogen as from Item F via pipeline 141 to either initial reactor 100 or one or more subsequent reactors 200 has been found to help reduce salt formation within the reactor system of the present invention. The amount of purified oil from Item F recycled back into the apparatus of the present invention is generally at least about 10% by volume, desirably about 25% by volume, and preferably about 50% by volume of the total purified oil fed to high pressure separator Item F. The amount of hydrogen that is recycled from high pressure separator Item F back into the apparatus system of the present invention is generally at least about 90% by volume, and desirably at least 95% by volume of the hydrogen fed to high pressure separator Item F.

The present invention will be better understood by reference to the following examples, some of which relate to initial failed examples that resulted in discovering the systems and methods the present invention used to produce a purified pyrolytic reactor waste oil.

The present invention in utilizing a hydrotreating process to eliminate various undesirable contaminants in the oil can have some undesirable side effects, as well as various processing problems. One such problem is the generation of a high exotherm when the noted plastic pyrolysis oil is hydrotreated. Another is the formation of salts.

Example 1

A 200 mL trickle bed reactor was loaded with hydrotreating catalyst and interstitial quartz beads. The reaction was run at 625° F. (329° C.) inlet temperature in a single reactor, at a liquid hourly space velocity (LHSV) of 1.0, and a pressure of 800 psig (5516 kPa). In this run, bed temperatures in the reactor rose to over 750° F. (399° C.), and coking occurred in the catalyst, leading to high pressure drops through the catalyst bed and eventual shutdown. When the run was repeated at lower inlet temperature, around 500° F. (260° C.), coking was not found to be an issue. Hence, desired reaction temperatures in the first reactor are preferably about 500° F. (260° C.) or less.

Wash Water Treatment

In order to aid in removal of various salts such ammonium chloride salts, and the like, the contaminated oil egressed from one or more reactors is treated by a wash water injection that is utilized and is located in close proximity to second hydrotreater-catalytic reactor 200 such as within about 50 feet, and desirably within 20 feet, to prevent significant temperature drop. It is noted that ammonium chloride salt deposition is positively correlated with ammonia and acid partial pressures, and negatively correlated with temperature. As the temperature drops, salt is more likely to be deposited. As noted, the water wash is located close to the outlet of reactor 200 so there is less time for the stream to cool and salt to form. The injected water will dissolve the salt deposits and carry them out of the system. Enough water needs to be injected to avoid wetting salt deposits without fully dissolving them, which will lead to corrosion. The water wash will also tend to strip out compounds such as ammonia and hydrogen sulfide from the vapor phase, and wash ammonium bisulfide salts out of downstream heat exchangers and air coolers.

Example 2

Salt formation is an issue with hydrotreating waste plastic streams, and the above water washing system can remedy it. In the same runs as example 1, line pluggages were observed at the catalytic reactor. These were white salt deposits, very water soluble, and consistent with ammonium chloride salt. Analysis of the pyrolysis oils suggest that chloride content can be as high as several thousand parts per million, and nitrogen content of the oil as high as 1% by weight. These conditions will generate relatively high partial pressure of $NH_3$ and HCl as they are removed from the oil. The partial pressures of each, along with the temperature, are directly related to the probability of ammonium chloride salt formation. Moving the location of water wash to just outside of the reactor, about less than 20 feet as noted above and as shown in FIG. 2, (much earlier than typical prior hydrotreating operations) allowed continuous operation without salt plugging.

While inherently some salt formation will occur utilizing the hydrotreater-catalytic reactors of the present invention, it has been found that the same can be reduced.

Example 3

A 1,000 mL trickle bed reactor was loaded with commercial hydrotreating catalyst in a single reactor. The reaction in a first reactor 100 was initially run at conditions of 300 F (148° C.) inlet temperature, 1380 psig (9515 kPa), and an LHSV of approximately 2.5. The reaction was run for 5 hours with no increase in pressure drop between the start of the reactor and the cold separator. After 5 hours, the reactor pressure was decreased to 800 psig (5516 kPa) and run for 43 minutes before the pressure had increased by 30 psi, indicating salt had formed in a heat exchanger such as Item B. Flow was switched to a parallel second heat exchanger, not shown, and the pressure drop returned to normal. After 37 minutes of operation in the second heat exchanger, pressure drop had again begun to increase, suggesting salt formation. Water washing system cleared the pressure drop in both condensers.

Example 4

Figure 3:
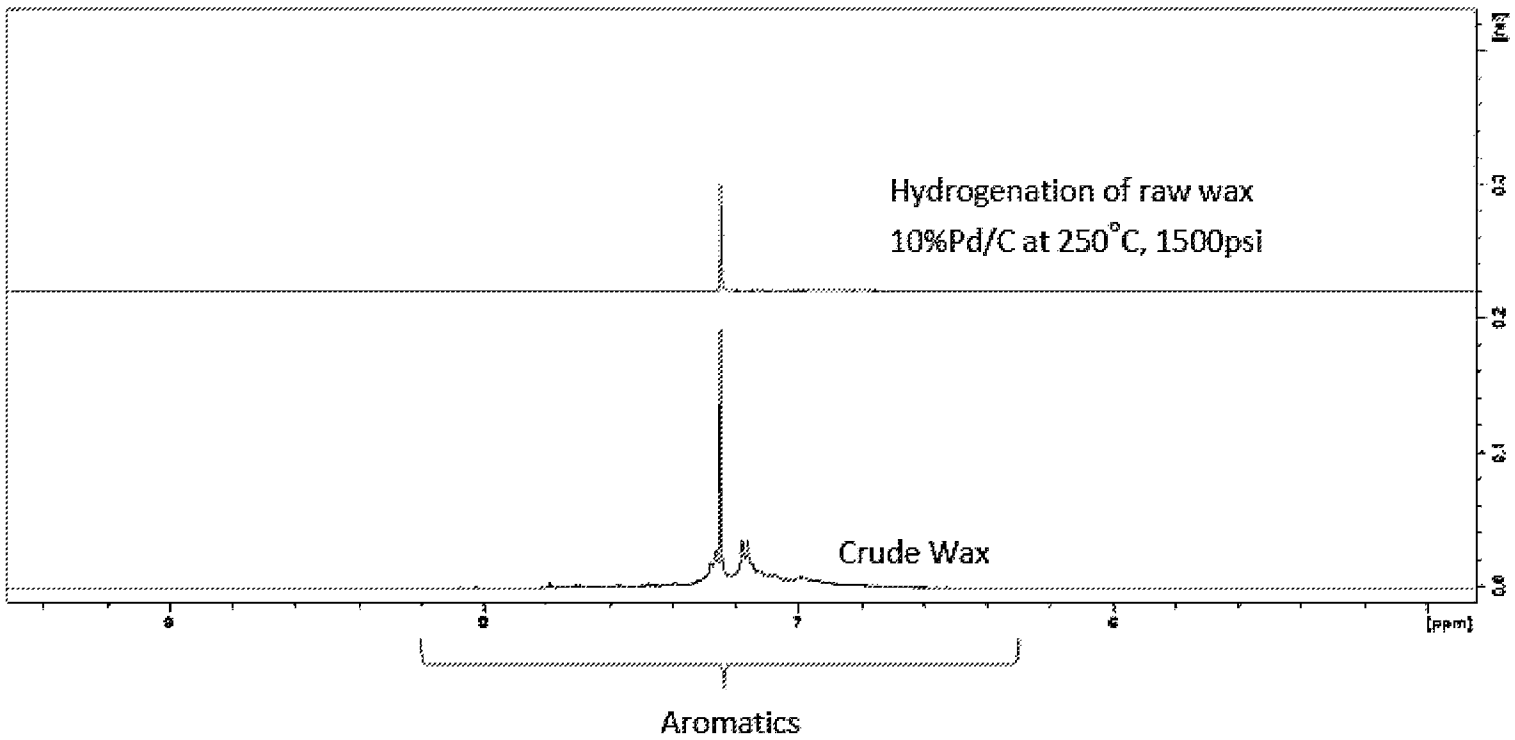
FIG. 3 illustrates NMR spectral data.

Paraffin wax from the plastic waste derived pyrolysis oil was dark in color, and is less preferred than white wax. Nuclear Magnetic Resonance (NMR) was performed on the feed wax to determine key functional groups. The wax was then hydrotreated at 1500 psig (10342 kPa) at an equivalent LHSV of 1, and 482° F. (250° C.) over palladium on carbon catalyst, producing a white wax at +10 Saybolt color. NMR was again run on the wax, and the peaks representing aromatic compounds were absent, see FIG. 3.

Water white wax was also achieved over a sulfided NiMo catalyst at 716° F. (380° C.) and 1350 psig (9308 kPa).

After the contaminated plastic waste derived oils have been treated in a manner as noted above, the purified oil, as shown in FIG. 2 was fed to a high-pressure separator, e.g. Item F, and subsequently a low pressure separator, Item G. The purpose of the separators is to separate liquids from vapors, not produce separate hydrocarbon liquid products. Item F, a high-pressure separator separates hydrogen from oil which is then sent to Item D, and water from oil, which water is ejected from the system. The second separator, Item G, a low-pressure separator 400, separates vapor in pipeline 120 from the oil via pipeline 140.

Example 5

Plastic derived pyrolysis oil was contacted with reverse osmosis permeate water at varying ratios, and mixed for up to 30 seconds to contact the oil with the water. The two phases were separated by centrifugation and then each phase sampled separately. The chloride in the oil phase started at 283 parts per million (ppm) chloride, and was reduced to an average of 201 ppm chloride after the water wash. Sulfur was similarly reduced from about 67 ppm to 55 ppm. The water phase was analyzed for phosphorus, and the removal of phosphorus calculated by mass balance. Starting phosphorus in the oil was about 30 ppm, and it was reduced by the water wash to about 10 ppm phosphorus.

Low molecular weight oil will have the lowest boiling point with the heavy fraction having the highest boiling point. Such produced molecular weight fractions can then generally be utilized with conventional oils for conventional uses. Example of such use include blending the lighter cut which is similar to conventional naphtha, in gasoline, or use in steam crackers to produce monomers that can be turned back into virgin plastics. The middle cut in pipeline 130 can, for example, be used as diesel fuel, where it has a high cetane number (measured at about 70) due to its high paraffin content. The heavy cut in pipeline 140 has high paraffin wax content, and can be deoiled by conventional means to make a paraffin wax product. Portions or all of the middle and heavy cuts can also be used in steam crackers, or in hydrocrackers, thermal crackers, or fluid catalytic crackers to produce monomers for plastic production. Still further, the lighter cut in particular has high aromatic content, and could be fed to an aromatics recovery process. Also, in order to be environmentally friendly, the low molecular weight oil can be recycled, that is fed to the various hydrotreatment-catalytic reactors and preferably to the first reactor to heat the same as by burning said oil fraction.

Light hydrocarbon vapors can be used as fuel or also go to a steam cracker. Heavier middle cuts and heavy cuts, as they are highly paraffinic, can be a good feedstock for isomerization reactors to make high performing lubricant base oils, and the liquid portions of these cuts could also be fractionated for use in base oils. Fractionation of the full product can also produce other fuels, such as jet fuel, kerosene, marine fuel, and the like, or petroleum products such as asphalt.

It is notable that hydrotreatment will result in a product stream that contains less wax than initially, without incorporating common cracking catalysts such as zeolites. This is accomplished by utilizing a catalyst that uses the halides generated in the process to cause cracking reactions, leading to fewer heavy, paraffinic hydrocarbons that constitute wax. This benefits the full system because wax would otherwise form solids in cold heat exchangers and plug piping, exchangers, and the like, making operability difficult.

Another unique aspect of the invention is that the hydrotreater reactor is fed a full range hydrocarbon stream. That is, it is not previously separated into naphtha, gas oil, or residual streams before hydroprocessing, as is typical in a refinery. The composite feed stream has all of the components, which allows for treatment of the oil to stringent specifications at a lower capital requirement.

It is desired to keep hydrogen partial pressure high. Recycle hydrogen is good because the chlorides, ammonia, and hydrogen sulfide allow clean hydrogen to be recycled and reduces the partial pressure of those contaminants, reducing the likelihood of salt deposition.

DMDS or other sulfur donating compounds, such as DMSO and the like can be added in case the feed oil does not have enough sulfur to keep the catalyst active. Sulfur is required for certain catalysts to effectively remove heteroatoms.

While in accordance with the patent statues, the best mode and preferred embodiment have been set forth, the scope of the invention is not limited thereto, but rather by the scope of the attached claims.

What is claimed is:

1. A method for removing contaminants from a pyrolyzed plastic feed stream containing various hydrocarbon oils and contaminants, comprising the steps of:

feeding a full boiling point range, with boiling points ranging from about 100° F. (38° C.) to about 1200° F. (648° C.), of a contaminated oil feed stream at a temperature of from about 200° F. (93° C.) to about 750° F. (399° C.) to a first catalytic reactor of a multiple reactor system comprising the first catalytic reactor and one or more subsequent reactors including a second reactor, the contaminants comprising one or more olefins, or one or more metals, or one or more organic metal compounds; or one or more salts, or one or more particulate containing compounds, or one or more heteroatoms; or one or more halogens, or any combination thereof;

treating the oil feed stream with hydrogen to hydrogen saturate the contaminants in the first catalytic reactor thereby producing reacted contaminants, wherein the partial hydrogen pressure of the first reactor is from about 200 (1379 kPa) to about 2,000 psig (13790 kPa);

transferring the oil feed stream including the reacted contaminants to the second reactor;

feeding additional hydrogen to the second reactor which has a temperature higher than the first reactor and a partial hydrogen pressure of at least about 200 psig (1379 kPa) to about 2,000 psig (13790 kPa);

injecting wash water into the contaminated oil feed stream downstream from and in close proximity to a last of the one or more subsequent reactors and upstream from both of a) a heat exchanger and b) a reactor recovery system including a separator, wherein the heat exchanger is located upstream from the reactor recovery system; and removing the reacted contaminants comprising the one or more reacted olefins, or the one or more reacted metals, or the one or more reacted salts, or the one or more reacted particulate containing compounds, or the one or more reacted heteroatoms, or the one or more reacted halogens, or any combination thereof, from the multiple reactor system.

2. The method of claim 1, wherein the wash water is injected within 20 feet of the last of the one or more subsequent reactors.

3. The method of claim 1, further including the step of recycling a quantity of the hydrogen treated oil feed stream from the separator, located downstream from one of the subsequent reactors, back into the first reactor, and further including the step of mixing hydrogen gas with the oil feed stream before it enters the first catalytic reactor.

4. The method of claim 1, wherein the one or more olefins comprise an olefin having a total of from 2 to about 40 carbon atoms; wherein the one or more of metals comprise an elemental metal; wherein the particulate containing compounds comprises sodium, calcium, nickel, vanadium, iron, copper, zinc, or potassium, or any combination thereof; wherein the one or more heteroatoms comprise nitrogen, silicon, phosphorous, sulfur, or oxygen, or any combination thereof; wherein the one or more halogens comprise chlorine, bromine, or fluorine, or any combination thereof, and further including the step of injecting additional wash water into the contaminated oil feed stream downstream from the heat exchanger and upstream from the reactor recovery system.

5. The method of claim 1, including reacting a majority of said olefins in the first or the one or more subsequent reactors, wherein the oil temperature of the oil feed stream fed to the first reactor is from about 225° F. (107° C.) to about 600° F. (316° C.), wherein the partial hydrogen pressure thereof is from about 600 psig (4137 kPa) to about 1,600 psig (11032 kPa), and independently, reacting unreacted olefins with hydrogen gas in the second or the one or more subsequent reactors, and converting the olefins to an alkane, wherein a temperature of the oil feed stream fed to the one or more subsequent reactors, independently, is from about 550° F. (288° C.) to about 900° F. (482° C.) and wherein the partial pressure in the one or more subsequent reactors, independently, is from about 400 psig (2758 kPa) to about 1,600 psig (11031 kPa).

6. The method of claim 5, wherein the oil temperature of the oil feed stream fed to the first reactor is from about 250° F. (121° C.) to about 500° F. (260° C.) and the partial hydrogen pressure thereof is from about 600 psig (4137 kPa) to about 1,600 psig (11032 kPa), and wherein the oil temperature of the oil feed stream fed to the one or more subsequent reactors, independently, is from about 650° F. (343° C.) to about 750° F. (399° C.), wherein the partial hydrogen pressure thereof is from about 600 psig (4137 kPa) to about 1,600 psig (11032 kPa), and optionally recycling the hydrogen and optionally recycling the oil.

7. The method of claim 1, further including the step of tracking of an amount of nitrogen and halides being fed to the first reactor to ensure that there is enough nitrogen to neutralize the halides in the feed stream.

8. The method of claim 1, further including the step of water washing the contaminated oil feed stream, then separating the wash water before feeding the contaminated oil feed stream to the first reactor, in order to remove some contaminants.

9. The method of claim 3, wherein the separator is a high pressure separator having a pressure of at least 400 psig (2758 kPa); and further including a second separator that is a low pressure separator capable of having a pressure of about 100 psig (690 kPa) or less; wherein the high pressure separator is capable of separating unreacted hydrogen, water, the hydrogen treated oil, and reacted heteroatom contaminants.

10. The method of claim 5, wherein the oil temperature of the oil feed stream fed to the first reactor temperature in the first reactor is from about 250° F. (121° C.) to about 500° F. (260° C.), and wherein the oil temperature of the oil feed stream fed to the one or more subsequent reactors, independently, is from about 650° F. (343° C.) to about 750° F. (399° C.).

11. The method of claim 10, including a water feed line, wherein the water feed line is connected to a pipeline connected to an outlet of the second reactor adjacent to the outlet, and wherein the wash water is injected into the pipeline from the water feed line, and wherein the water feed line is located upstream from a static mixer which is located upstream from the heat exchanger.

12. The method of claim 1, further including the step of performing a cracking reaction with a catalyst present in one or more of the first catalytic reactor and the one or more subsequent reactors which utilizes the one or more halogen contaminants in the reaction.

13. The method according to claim 1, wherein one or more of the first reactor and the one or more subsequent reactors, independently, contain one or more of perforated trays and perforated tubes.

14. An apparatus for removing contaminants contained in a contaminated oil feed stream derived from a pyrolyzed plastic material, comprising:

a first hydrotreater reactor capable of reacting hydrogen gas with a component of the contaminated oil feed stream;

at least one or more subsequent hydrotreater reactors located downstream from the first hydrotreater reactor in a process flow line and, independently, capable of further reacting additional hydrogen gas with a component of the contaminated oil feed stream;

wherein the contaminants comprise one or more olefins, or one or more metals, or one or more organic metal compounds, or one or more salts, or one or more particulate containing compounds, or one or more heteroatoms, or one or more halogens, or any combination thereof;

at least one water wash pipeline that is connected to a pipeline connected to an outlet of the at least one or more subsequent hydrotreater reactors which is capable of introducing water into the pipeline from the water wash pipeline in close proximity to a last of the one or more subsequent hydrotreater reactors;

a heat exchanger downstream from the water feed line; and at least one separator operatively connected downstream from a) the last of the one or more subsequent hydrotreater reactors, b) the at least one water wash pipeline and c) a heat exchanger downstream from the water wash pipeline, the at least one separator capable of separating one or more reacted olefins, or one or more reacted heteroatoms, or any combination thereof from the contaminated oil feed stream.

15. The apparatus of claim 14, further including at least one heater that heats the contaminated oil feed stream before it is admitted to the first reactor; further including at least one or more subsequent heaters that heat the contaminated oil feed stream egressing from the first reactor to a temperature of about 550° F. (288° C.) to about 900° F. (282° C.) prior to being fed to at least one of the at least one subsequent hydrotreater reactors, and wherein the wash water is injected within 20 feet of the last of the one or more subsequent reactors.

16. The apparatus of claim 15, further including at least two separators, with the first separator being a high pressure separator having a pressure of at least 400 psig (2758 kPa) and a second separator that is a low pressure separator having a pressure of about 100 psig (690 kPa) and/or wherein the low pressure separator is capable of separating gas from the hydrotreated oil received from the high pressure separator which is located upstream from the low pressure separator.

17. The apparatus of claim 14, further including a recycle line extending from the at least one separator to the first reactor, whereby a portion of the hydrotreated oil from the separator is recyclable to the first reactor, and a hydrogen gas pipeline connected to a contaminated oil feed pipeline whereby hydrogen gas is mixed with the contaminated oil feed before it enters the first hydrotreater reactor.

18. The apparatus of claim 14, further including a water washing station located upstream from the first hydrotreater reactor which is capable of washing the contaminated oil feed stream in order to remove some contaminants prior to the contaminated oil feed stream being transferred to the first hydrotreater reactor.

19. The apparatus of claim 14, further including a catalyst in one or more of the first hydrotreater reactor and the at least one or more subsequent hydrotreater reactors which can utilize the one or more halogens in a cracking reaction.

20. The apparatus according to claim 14, wherein one or more of the first catalytic reactor and the one or more subsequent reactors, independently, contain one or more of perforated trays and perforated tubes, and wherein the water feed line is located upstream from a static mixer which is located upstream from the heat exchanger.

21. The apparatus according to claim 14, further including a second wash water pipeline that is connected to a pipeline connected downstream from the heat exchanger, wherein the second wash water pipeline is capable of introducing water into the pipeline downstream from the heat exchanger and upstream from the at least one separator.

* * * * *